US008745790B1

(12) United States Patent
Wyrozub

(10) Patent No.: US 8,745,790 B1
(45) Date of Patent: Jun. 10, 2014

(54) ARM SUPPORT FOR SURGICAL TABLE

(71) Applicant: Cindy Wyrozub, Edmonton (CA)

(72) Inventor: Cindy Wyrozub, Edmonton (CA)

( * ) Notice: Subject to any disclaimer, the term of this patent is extended or adjusted under 35 U.S.C. 154(b) by 0 days.

(21) Appl. No.: 13/936,305

(22) Filed: Jul. 8, 2013

(30) Foreign Application Priority Data

Apr. 9, 2013 (CA) ..... 2812513

(51) Int. Cl.
*A61G 15/00* (2006.01)

(52) U.S. Cl.
USPC ..... 5/623; 5/621

(58) Field of Classification Search
USPC ..... 5/621–624, 601, 646, 648
See application file for complete search history.

(56) References Cited

U.S. PATENT DOCUMENTS

| | | | | |
|---|---|---|---|---|
| 2,910,259 | A | 1/1959 | Johnson | |
| 4,210,317 | A | 7/1980 | Spann et al. | |
| 4,681,308 | A | 7/1987 | Rice | |
| 4,730,801 | A | 3/1988 | Cloward | |
| D354,079 | S | 1/1995 | Shapiro | |
| 5,408,713 | A | 4/1995 | Stratton et al. | |
| 6,101,650 | A | 8/2000 | Omdal et al. | |
| 7,603,730 | B2 | 10/2009 | Zelnik | |
| D605,498 | S | 12/2009 | Carl | |
| D607,311 | S | 1/2010 | Snider | |
| 2008/0005841 | A1 * | 1/2008 | Zelnik et al. | 5/601 |
| 2008/0236599 | A1 | 10/2008 | Earle | |

* cited by examiner

*Primary Examiner* — Fredrick Conley
(74) *Attorney, Agent, or Firm* — Davis & Bujold, PLLC; Michael J. Bujold

(57) ABSTRACT

An arm support for a surgical table is described which includes a C channel coupling having an upper plate, a lower plate and a web plate connecting the upper place with the lower plate. A cradle, which is capable of supporting at least one arm, depends from the lower plate. The C channel is extended from below through a face opening in a surgical table to secure the apparatus to the surgical table.

6 Claims, 4 Drawing Sheets

ARM SUPPORT FOR SURGICAL TABLE

FIELD

There is described an arm support which is used to support an arm of a patient lying prone on a surgical table.

BACKGROUND

Back surgery is currently being performed using a localize anesthetic. In the absence of an arm support, patients are placed in a prone position with their arms dangling down. As surgery progresses, the patient becomes increasingly uncomfortable with his or her arms dangling down, which prompts the patient to attempt movement. Such movement during delicate back surgery can be hazardous to the health and safety of the patient. There is a need for an arm support that can be attached to a surgical table. Some solutions have been presented in prior patents, such as U.S. Pat. No. 2,910,259 (Johnson) entitled "Arm Rest", U.S. Pat. No. 6,101,650 (Omdal et al) entitled "Recessed Arm Board" and U.S. Patent Publication 2008/0236599 (Earle) entitled "Arm Board Adaptor For Surgical Table".

SUMMARY

According to one aspect there is provided an arm support for a surgical table which includes a C channel coupling having an upper plate, a lower plate and a web plate connecting the upper place with the lower plate. A cradle, which is capable of supporting at least one arm, depends from the lower plate.

It is preferred that the cradle is made of carbon fibre or some other material that will not interfere with X-rays and other diagnostic equipment.

As arm support 10 is positioned under the forehead of a patient lying prone and guides the arms in a rested position out of the line of x-rays, alternate materials such as plastic or fibreglass may also be used as the arm support is positioned away from the spine of the patient.

According to another aspect there is provided a method of supporting an arm from a surgical table. The method uses the apparatus, as described above. The C channel of the apparatus is inserted from below into a face opening at a head end of the surgical table and the cradle is oriented to extend past the head end of the surgical table. The C channel is then pushed into engagement with the surgical table with the upper plate resting on the top surface along a head end edge of the face opening and the lower plate engaging a bottom surface along the head end edge of the face opening.

During use, the arms of the patient exert a force which maintains the C channel engaged with the surgical table. In theory, the C channel could drop back down through the face opening if pulled out of engagement with the surgical table. It is, therefore, preferred that the relative shape of the face opening and the C channel be such that the C channel must be rotated 90 degrees to be inserted or removed from the face opening. This serves as a safety precaution, as the C channel cannot be removed from the face opening unless rotated.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
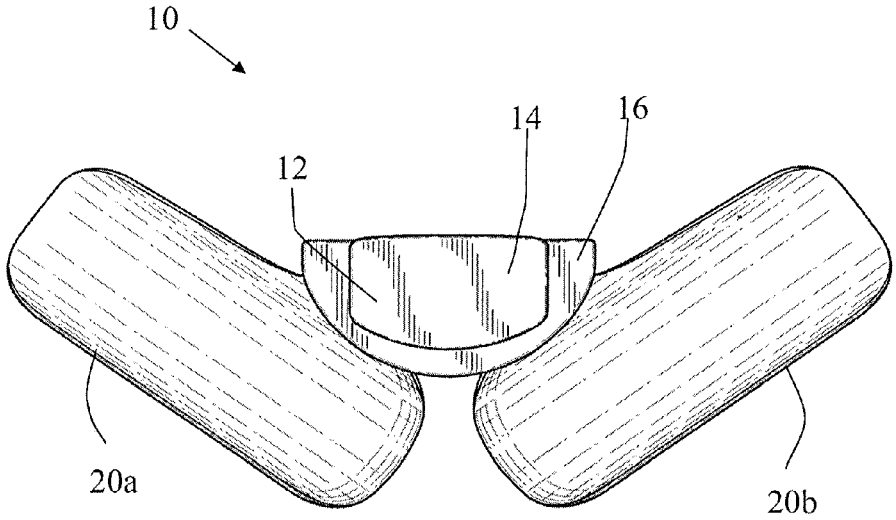
FIG. 1 is a top plan view of an arm support for a surgical table.

An arm support for a surgical table generally identified by reference numeral 10, will now be described with reference to FIG. 1 through 6.

Figure 2:
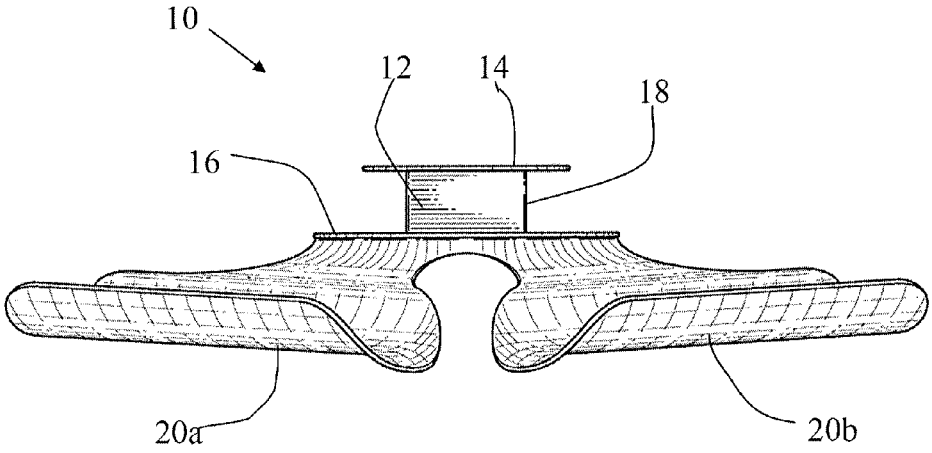
FIG. 2 is a front elevation view of the arm support for a surgical table shown in FIG. 1.
Figure 3:
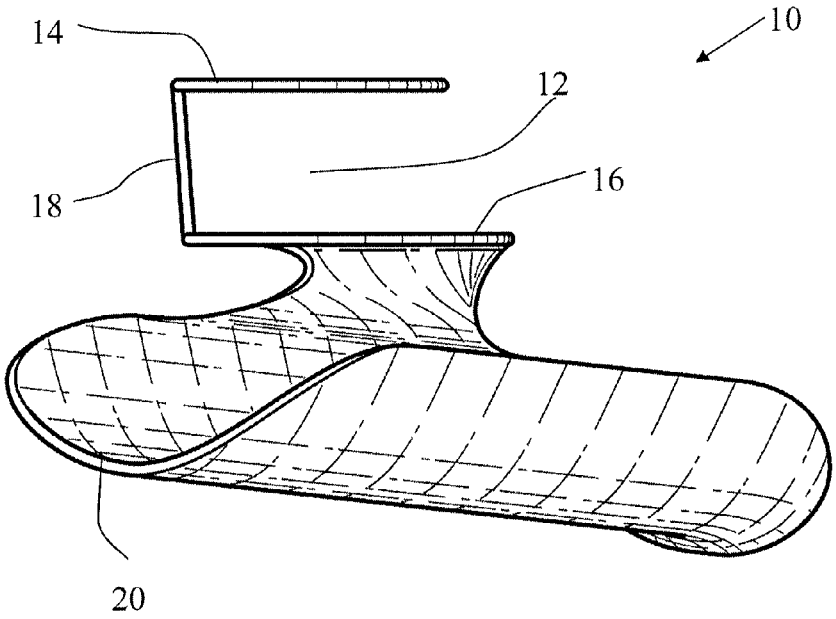
FIG. 3 is a side elevation view of the arm support for a surgical table shown in FIG. 1.

Structure and Relationship of Parts:

Referring to FIGS. 1 and 2, an arm support for a surgical table 10 has a C channel coupling 12 with an upper plate 14 and a lower plate 16. Referring to FIG. 2 and FIG. 3, upper plate 14 and lower plate 16 are connected by a web plate 18. A cradle 20 depends from lower plate 16 and is capable of supporting at least one arm. In the embodiment shown, cradle 20 is made of two arm supports 20*a* and 20*b* which each support an arm of a patient. It will be understood that cradle 20 may be designed such that both arms of the patient are supported by a single arm support structure. Cradle 20 may be made of any suitable material able to support at least one arm of a user. It is, however, preferred that cradle 20 be made of carbon fibre or other material that does not interfere with X-rays and other diagnostic equipment. As arm support 10 is positioned under the forehead of a patient lying prone and guides the arms in a rested position out of the line of x-rays, alternate materials such as plastic or fibreglass may also be used as arm support 10 is positioned away from the spine of the patient.

Figure 4:
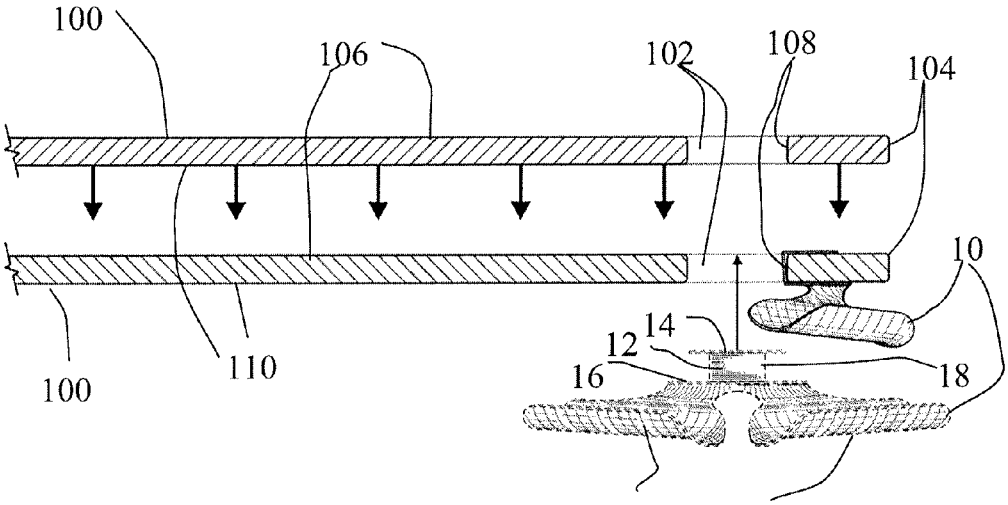
FIG. 4 is a side elevation view of a surgical table with the arm support being rotated for attachment to the surgical table.
Figure 5:
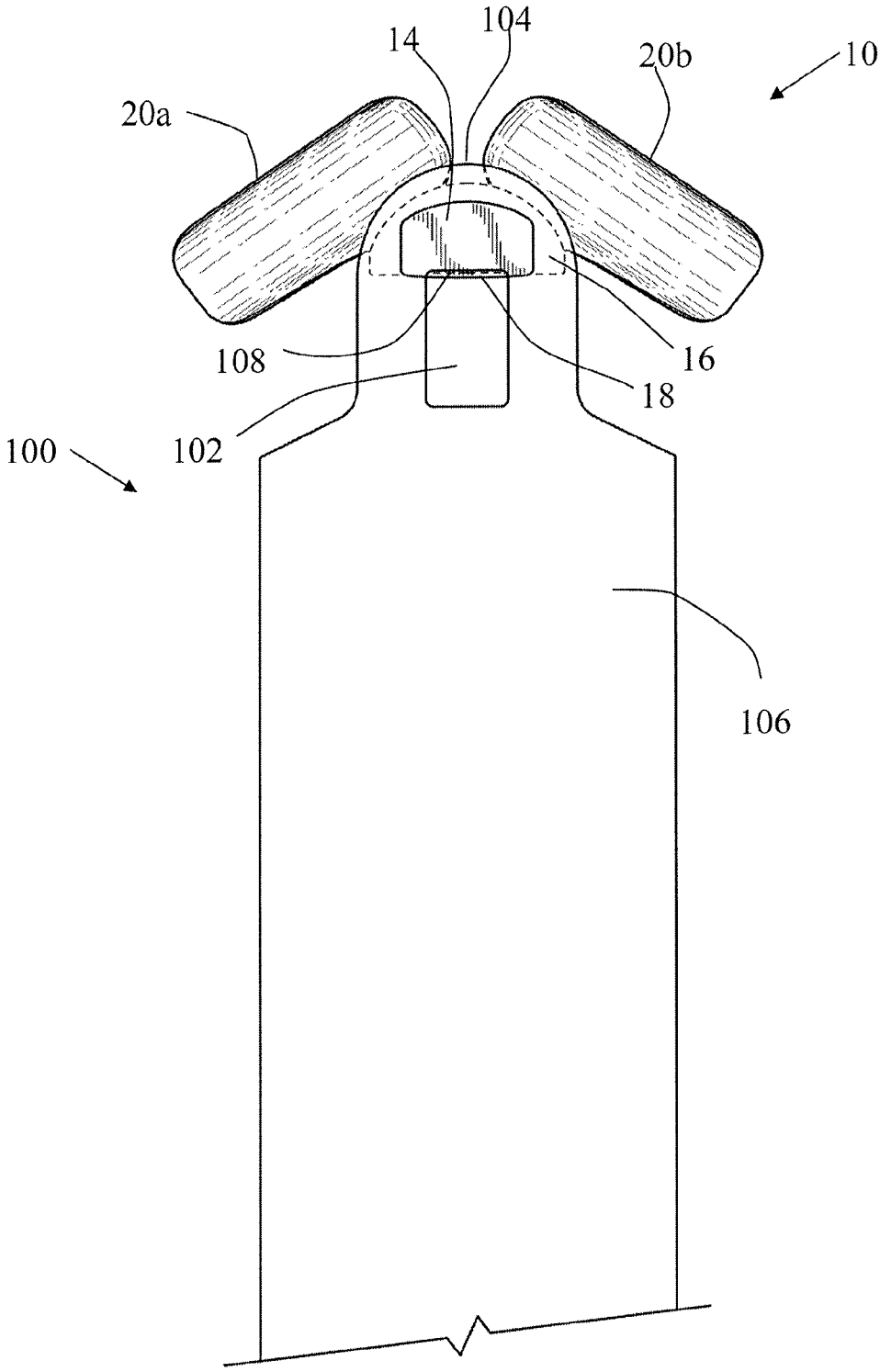
FIG. 5 is a partially transparent top plan view of a surgical table with the arm support attached.

In the embodiment shown, C channel coupling 12 is sized to be inserted into a face opening 102 at a head end 104 of a surgical table 100 and attached to surgical table 100 with upper plate 14 resting on a top surface 106 along a head end edge 108 of face opening 102 and lower plate 16 engaging a bottom surface 110 along head end edge 108 of face opening 102. It will be understood that C channel coupling 12 may be sized to be inserted and attached to any suitable surface. Referring to FIG. 4, to reduce the possibility of C channel coupling 12 becoming disengaged from head end edge 108 of face opening 102, a preferred embodiment requires that C channel coupling 12 be sized such that it must be rotated 90 degrees to be inserted or removed from face opening 102. This sizing of C channel coupling 12 allows arm support 10 to be installed without the requirement for additional hardware. Arm support 10 will not fall out of face opening 102 with backward slippage as the 90 degree turn is required to remove arm support 12 from surgical table 100. Referring to FIG. 5, web plate 18 is sized to fit within face opening 102 when arm support 10 is attached to surgical table 100. This allows web plate 18 to rest flush against head end edge 108 of surgical table 100 while upper plate 14 and lower plate 16 are longer in length to provide for increased surface area connection while resting along top surface 106 or engaging bottom surface 110, respectively.

Figure 6:
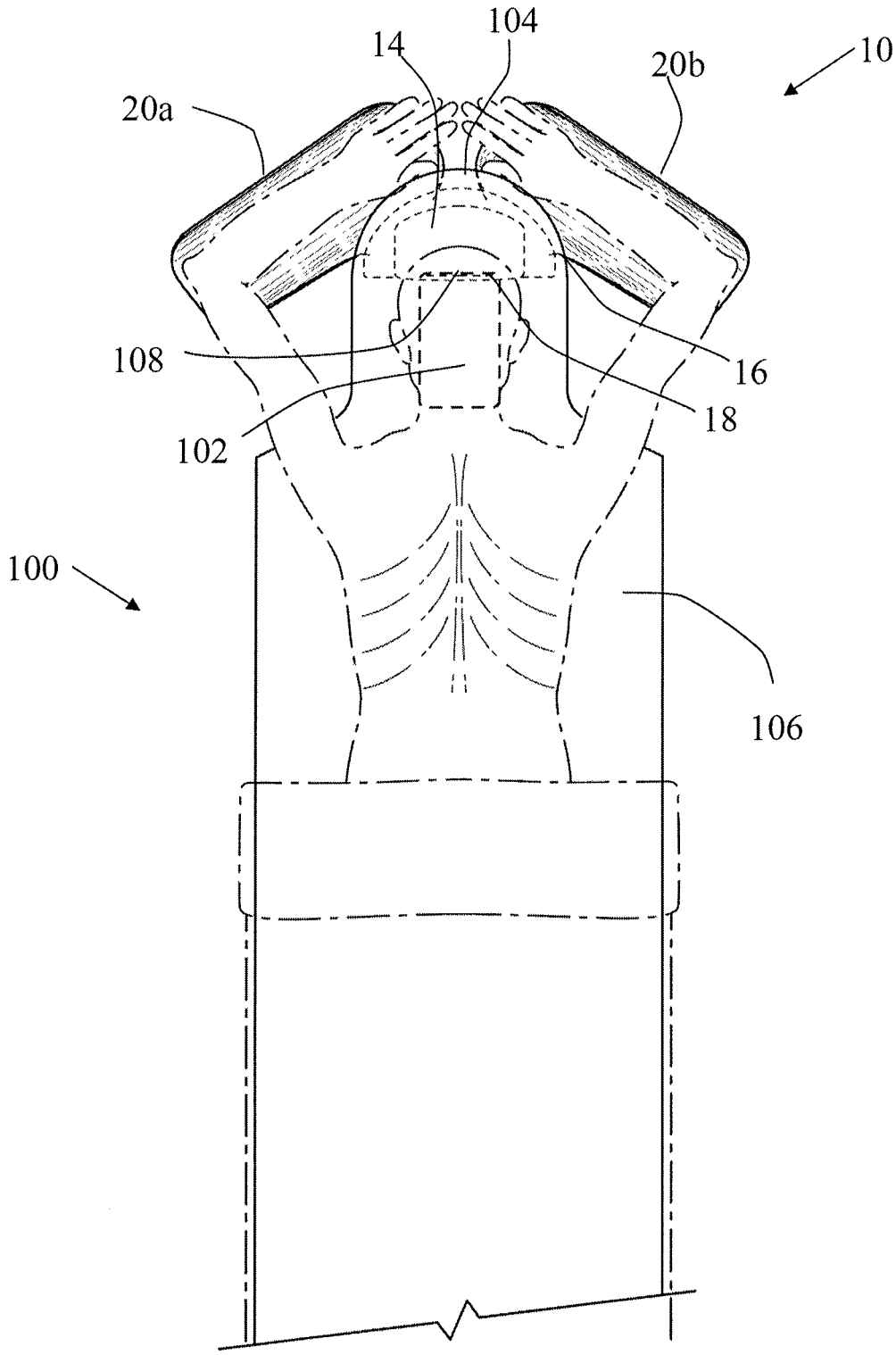
FIG. 6 is a partially transparent top plan view of the surgical table with arm support attached shown in FIG. 5, with a patient lying on the table with their arms supported by the arm support.

Operation:

Referring to FIG. 4, C channel 12 of arm support 10 is inserted from below into face opening 102 at head end 104 of surgical table 100. As shown in the present embodiment, C channel 12 is sized such that it must be rotated 90 degrees to be inserted or removed from face opening 102. This serves as a safety precaution, as C channel 12 cannot be removed from face opening 102 unless rotated. Cradle 20 is oriented to extend past head end 104 of surgical table 100 to allow a user's arms to rest in a position in front of their head. Referring to FIG. 5, C channel 12 is then pushed into engagement with surgical table 100 such that upper plate 14 rests on top surface 106 along head end edge 108 of face opening 102 and lower plate 16 engages bottom surface 110 along head end edge 108 of face opening 102. Web plate 18 may act as a stop as it contacts head end edge 108 and prevents sliding of C channel 12 off head end 104 of surgical table 100. Referring to FIG. 6, during use, the arms of the patient exert a force which maintains C channel 12 engaged with surgical table 100.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

What is claimed is:

1. An arm support for a surgical table, comprising:

a C channel coupling having an upper plate, a lower plate and a web plate connecting the upper plate with the lower plate and defining a table receiving opening, the upper plate being designed to fit through a face opening of the surgical table in a first orientation, and to be supported by the face opening in a second orientation rotated 90 degrees relative to the first orientation; and a cradle depending from the lower plate and extending back and away from the table receiving opening, the cradle being positioned below the face opening of the surgical table when the upper plate is supported by the face opening, and capable of supporting at least one arm.

2. The arm support of claim 1, wherein the cradle is made of carbon fibre.

3. The arm support of claim 1, wherein the cradle is made of plastic.

4. The arm support of claim 1, wherein the cradle is made of fibreglass.

5. A method of supporting an arm from a surgical table, comprising:

providing an arm support, comprising:

a C channel coupling having an upper plate, a lower plate and a web plate connecting the upper place with the lower plate; and a cradle depending from the lower plate, the cradle being capable of supporting at least one arm;

inserting the C channel into a face opening at a head end of the surgical table and orienting the cradle to extend past the head end of the surgical table; and attaching the C channel to the surgical table with the upper plate resting on the top surface along a head end edge of the face opening and the lower plate engaging a bottom surface along the head end edge of the face opening.

6. The method of claim 5, wherein the relative shape of the face opening and the C channel being such that the C channel must be rotated 90 degrees to be inserted or removed from the face opening.

* * * * *